US006101747A

United States Patent [19]

Myles

[11] Patent Number: 6,101,747

[45] Date of Patent: Aug. 15, 2000

[54] ATHLETIC SHOE HAVING BASKETBALL HOOP

[76] Inventor: Gregg A. Myles, 1636 W. 12th Ave., Gary, Ind. 46404

[21] Appl. No.: 09/235,911

[22] Filed: Jan. 25, 1999

[51] Int. Cl.[7] ..... A43B 23/00; A63B 67/00

[52] U.S. Cl. ..... 36/136; 273/317.3; 273/DIG. 18; 273/DIG. 30

[58] Field of Search ..... 36/1, 112, 127, 36/132, 136, 137; 273/DIG. 18, DIG. 30, 317.3, 317.1, 440, 447, 453

[56] References Cited

U.S. PATENT DOCUMENTS

| | | | |
|---|---|---|---|
| 1,637,278 | 7/1927 | Renz | 273/DIG. 18 |
| 3,724,855 | 4/1973 | Chu | 273/317.3 |
| 4,718,676 | 1/1988 | Collins, Jr. | 273/DIG. 18 |
| 5,473,518 | 12/1995 | Haber et al. | 36/137 |
| 5,508,899 | 4/1996 | McCormick | 36/137 |
| 5,651,742 | 7/1997 | Dickson | 273/DIG. 18 |
| 5,709,385 | 1/1998 | Fitzpatrick et al. | 273/317.3 |

*Primary Examiner*—Paul T. Sewell
*Assistant Examiner*—Jila Mohandesi
*Attorney, Agent, or Firm*—Gilhooly & Crossman

[57] ABSTRACT

An athletic shoe having basketball assembly including a flat backboard affixed to the athletic shoe. A rim is attached to the backboard and supports a flexible net.

3 Claims, 1 Drawing Sheet

ATHLETIC SHOE HAVING BASKETBALL HOOP

BACKGROUND OF THE INVENTION

1. Field of the Invention

This invention relates to athletic shoes and, more particularly, an athletic shoes having a basketball basket and ball for children.

2. Summary of the Prior Art

Athletic shoes of many designs are available in the marketplace. Some shoes include novelty and functional features such as lights, pictures, logos and the like. Because basketball is a popular sport, there is a need in the market to provide a shoe identified with basketball, particularly, to the delight of the young.

SUMMARY OF THE INVENTION

It is, therefore, an objective of this invention to provide athletic shoes with a miniature backboard, basket and ball for aesthetic reasons and to function as a toy for the young. The miniature basket and back board is attached to the back of the athletic shoe. A removable miniature basketball may be affixed to the background and may be removed to permit simulation of shooting baskets, particularly enjoyed by young children.

DESCRIPTION OF THE PREFERRED EMBODIMENT

Figure 1:
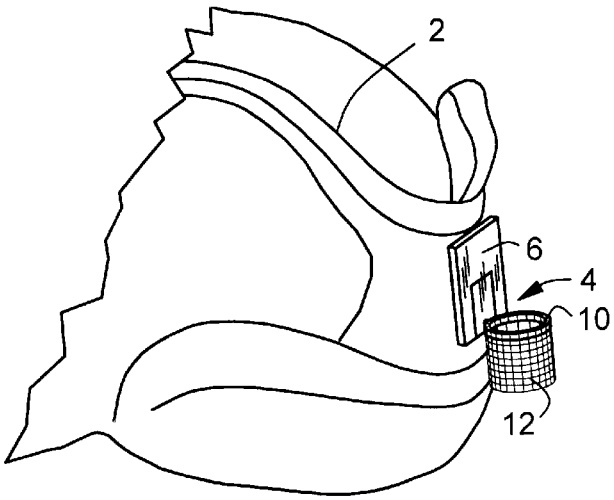
FIG. 1 is a side perspective view, with parts in section of an athletic shoe and miniature basketball assembly of the invention.
Figure 2:
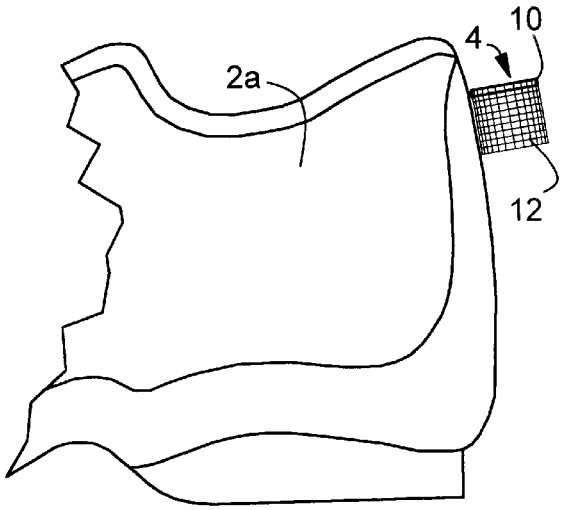
FIG. 2 is a side elevational view, with parts in section, of an athletic shoe of a different design than FIG. 1 and miniature basketball assembly of the invention.
Figure 3:
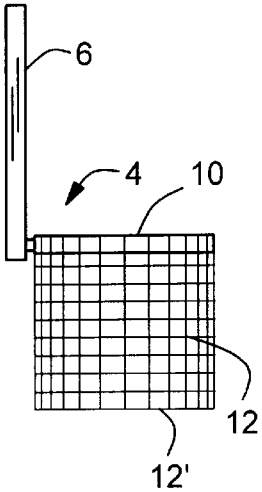
FIG. 3 is a side elevational view of the miniature basketball assembly of the invention for use with the athletic shoe of FIGS. 1 and 2.

Referring now to FIGS. 1 to 7 there is illustrated athletic shoes 2 and 2*a* having a miniature basketball assembly 4 of the invention. Although portions of particular designs of athletic shoes 2 and 2*a* are shown in FIGS. 1 and 2, it is within the scope of the invention to attach miniature basketball assembly 4 to any style of shoe.

Figure 4:
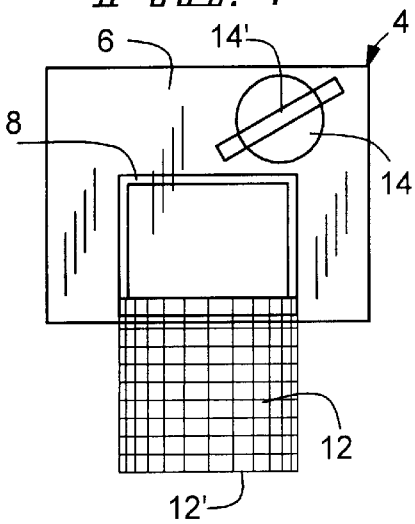
FIG. 4 is a front elevational view of the miniature basketball assembly of FIG. 3.
Figure 5:
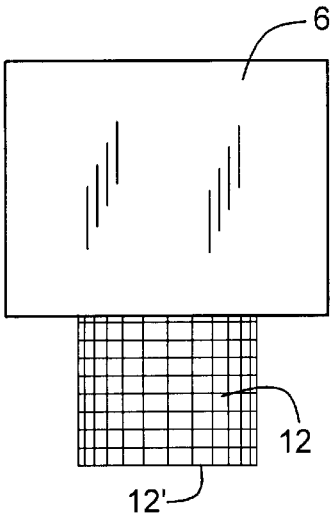
FIG. 5 is a back elevational view of the miniature basketball assembly of FIG. 3.
Figure 6:
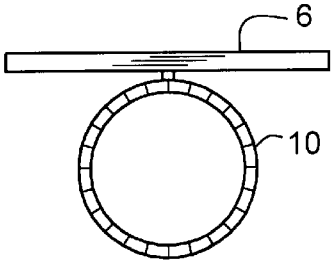
FIG. 6 is a top plan view of the miniature basketball assembly of FIG. 3.
Figure 7:
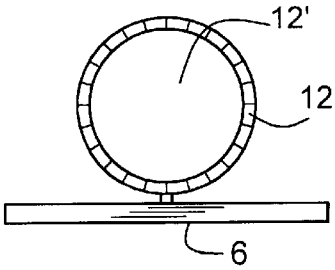
FIG. 7 is a bottom plan view of the miniature basketball assembly of FIG. 3.

The miniature basketball assembly 4 includes a flat, rectangular backboard 6 formed from a plastic material. The backboard 6 is affixed to the back surface of the heel of an athletic shoe 2 or 2*a* by an adhesive or other attachment technique (not shown). The backboard 6 may have a rectangular lined background 8 (FIG. 4) above a miniature circular rim 10 and net 12 having any shape with open bottom 12'. The backboard may have objects bounded off of it. The rim 10 may be be fabricated from a plastic material and is affixed to backboard 6 by adhesive or other securement technique. The net 12 is made from a flexible or rigid fabric and is secured to rim 10 by any conventional technique. A miniature basketball 14 may be used with the basketball assembly 4 and can be taped by tape 14*a* or otherwise affixed to backboard 6 (FIG. 4). The ball 14 may be removed and used to make shots at the basketball assembly 4 whereby the shoe can also be a toy for the youth. The ball may be formed from foam, plastic or elastomeric material. In absence of a basketball 14, a child can also throw other small objects through the basket during play when the shoe is worn by another or removed by the player himself. The basketball assembly 4 not only provides a stylish shoe associated with basketball, but also may be used as a game or toy. The rim and basket ban further be directly attached to the athletic shoe 2 without backboard 6 as in FIG. 2.

What is claimed is:

1. An athletic shoe assembly comprising an athletic shoe having a heel forming a back exterior surface, a miniature basketball backboard, means for affixing said backboard to said back exterior surface, a circular rim being affixed to the miniature basketball backboard, and a net hanging from said rim for allowing thrown objects to pass through.

2. The athletic shoe assembly of claim 1 further comprising a miniature basketball for use with said rim and net.

3. The athletic shoe assembly of claim 1 wherein said backboard being formed from a flat plastic, said circular rim being formed from a plastic.

* * * * *